US008819960B2

(12) United States Patent
Nishida

(10) Patent No.: US 8,819,960 B2
(45) Date of Patent: Sep. 2, 2014

(54) BUCKLE

(75) Inventor: Yasushi Nishida, Osaka (JP)

(73) Assignee: Doggyman H. A. Co., Ltd., Osaka (JP)

( * ) Notice: Subject to any disclaimer, the term of this patent is extended or adjusted under 35 U.S.C. 154(b) by 282 days.

(21) Appl. No.: 13/489,823

(22) Filed: Jun. 6, 2012

(65) Prior Publication Data

US 2013/0298359 A1 Nov. 14, 2013

(30) Foreign Application Priority Data

May 9, 2012 (JP) ..... 2012-107387

(51) Int. Cl.
*A44B 11/20* (2006.01)

(52) U.S. Cl.
USPC ..... 34/634; 24/638

(58) Field of Classification Search
None
See application file for complete search history.

(56) References Cited

U.S. PATENT DOCUMENTS

| | | | | | |
|---|---|---|---|---|---|
| 813,838 | A | * | 2/1906 | Steinberg | 24/665 |
| 1,068,530 | A | * | 7/1913 | Phillips | 24/594.1 |
| 1,209,369 | A | * | 12/1916 | Wood | 24/648 |
| 1,459,673 | A | * | 6/1923 | Jabner | 24/634 |
| 3,201,840 | A | * | 8/1965 | Jantzen | 24/634 |
| 3,523,341 | A | * | 8/1970 | Spires | 24/632 |
| 3,523,342 | A | * | 8/1970 | Spires | 24/632 |
| 3,579,750 | A | * | 5/1971 | Carbon et al. | 24/650 |
| 3,605,210 | A | * | 9/1971 | Lohr | 24/635 |
| 3,623,194 | A | * | 11/1971 | Claeson | 24/635 |
| 3,649,999 | A | * | 3/1972 | Stoffel | 24/635 |
| 3,713,192 | A | * | 1/1973 | Wallin | 24/645 |
| 3,737,126 | A | * | 6/1973 | Martin | 244/151 B |
| 3,789,467 | A | * | 2/1974 | Aratani et al. | 24/648 |
| 3,851,360 | A | * | 12/1974 | Minolla | 24/656 |
| 3,871,090 | A | * | 3/1975 | Romanzi et al. | 200/61.58 B |
| 3,913,184 | A | * | 10/1975 | Hanan | 24/704.1 |
| 3,935,618 | A | * | 2/1976 | Fohl | 24/639 |
| 3,981,519 | A | * | 9/1976 | Cataldo | 297/474 |
| 4,171,557 | A | * | 10/1979 | Ennerdal et al. | 24/642 |
| 4,181,832 | A | * | 1/1980 | Ueda | 200/61.58 B |
| 4,228,567 | A | * | 10/1980 | Ikesue et al. | 24/642 |
| 4,245,377 | A | * | 1/1981 | Soltes | 24/625 |
| 4,307,494 | A | * | 12/1981 | Gasse et al. | 24/634 |
| 4,317,263 | A | * | 3/1982 | Fohl | 24/635 |
| 4,334,341 | A | * | 6/1982 | Krautz et al. | 24/635 |
| 4,355,442 | A | * | 10/1982 | Sato | 24/642 |
| 4,374,449 | A | * | 2/1983 | Stephenson et al. | 24/656 |
| 4,425,687 | A | * | 1/1984 | Sauer | 24/664 |
| 5,419,020 | A | * | 5/1995 | Murai | 24/625 |
| 5,604,964 | A | * | 2/1997 | Aoshima | 24/632 |
| 6,378,178 | B1 | * | 4/2002 | Pedersen et al. | 24/635 |
| 6,655,744 | B2 | * | 12/2003 | Petri et al. | 297/478 |
| 8,079,117 | B2 | * | 12/2011 | Pontaoe | 24/616 |
| 8,464,407 | B2 | * | 6/2013 | Von Der Ahe et al. | 24/634 |
| 8,561,268 | B2 | * | 10/2013 | Hortnagl | 24/648 |

* cited by examiner

*Primary Examiner* — Jack W. Lavinder
(74) *Attorney, Agent, or Firm* — Westerman, Hattori, Daniels & Adrian, LLP

(57) ABSTRACT

A simple light-weighten buckle including a male member having an inserting piece, a female member having an insertion port and a cover body storing the female member therein, wherein the inserting piece has a pair of concave engaged parts, the female member is formed of one elastic metal wire and has a base, a pair of arms that are bent and extend from respective ends of the base, a pair of bent parts provided in the middle of the respective arms, and a pair of engaging parts provided at respective front ends of the pair of arms, and the cover body has a cover main body, an insertion hole the inserting piece, a storage part that communicates with the insertion hole and stores the female member therein, and operating parts that can press the pair of respective bent parts inward from the outside of the cover body.

5 Claims, 5 Drawing Sheets

BUCKLE

FIELD OF THE INVENTION

The present invention relates to a buckle that detachably couples ends of an article such as a collar for animals, a bag belt or the like with each other.

BACKGROUND ART

The ends of a band-like body such as the collar for animals, the bag belt or the like are often coupled to each other via a buckle. Such buckle is generally configured of a detachable inserting body attached to one end of a belt and a coupling tool body that is attached to the other end of the belt and inserts the detachable inserting body thereinto, which can engage with each other.

For example, Patent document 1 (Unexamined Patent Publication No. 2003-102516, JP2003-102516A) proposes a coupling tool that attempts to obtain adequate strength while achieving reduction in size and weight. In the coupling tool in Patent document 1, a pair of hook-like protruding engaging claws are integrally formed on both respective sides of a detachable inserting body, while a coupling tool body is configured of upper and lower plates that have a storage part therebetween, a pair of engaging parts supported in the storage part so as to freely swing about respective spindles, and a spring member that biases engaging claws of the pair of engaging parts to get closer to each other. The engaging claws of the detachable inserting body engage with the engaging claws of the coupling tool body.

However, in the coupling tool in Patent document 1, in order to satisfy necessary strength, components of the detachable inserting body and the coupling tool body each are made of metal. Thus, the tool achieves adequate strength, but has a complicated structure including a lot of components, and is made of metal as a whole as mentioned above. As a result, the tool is considerably heavy.

Then, in order to provide an inexpensive and light-weighted buckle that includes a small number of components while achieving necessary and adequate strength, Inventors of Patent document 2 (Unexamined Patent Publication No. 2010-110502, JP2010-110502A) propose a buckle that couples a band-like body by inserting an inserting piece protrudingly provided on a male member into an insertion port of a female member.

More specifically, in the buckle in Patent document 2, the inserting piece of the male member includes a pair of engaged parts, and the female member is formed of one metal wire and includes a pair of arms that are bent and protruded from both respective ends of a base. The pair of arms are provided with a pair of respective engaging parts, integrally formed by bending, and the engaging parts can be engaged/disengaged with the engaged parts of the inserting piece as a distance between the arms are widened/narrowed due to elastic deformation.

CONVENTIONAL TECHNICAL DOCUMENT

Patent Document

[Patent document 1] JP2003-102516A
[Patent document 2] JP2010-110502A

DISCLOSURE OF THE INVENTION

Problems to be Solved by the Invention

However, although the buckle in Patent document 2 has adequate strength and a simple and light-weighted structure with a small number of components, there is a room for improvement in terms of the stability of the inserting piece of the male member during engagement with the female member and the easiness of release of engagement between the male member and the female member.

Therefore, an object of the present invention is to provide a buckle that has adequate strength and a simple and light-weighted structure with a small number of components, as well as is excellent in the stability of the inserting piece of the male member during engagement with the female member and the easiness of release of engagement between the male member and the female member.

Means Adapted to Solve the Invention

To attain the above-mentioned object, Inventors of the present invention have fabricated a lot of prototypes of a male member, a female member and a cover body storing the female member therein, and examined them in earnest. As a result, Inventors found that providing a pair of engaged parts with predetermined configuration in the male member could improve the stability of the inserting piece of the male member during engagement with the female member, and further that providing operating parts with predetermined configuration in the cover body storing the female member, and providing a pair of bent parts at predetermined positions of the pair of respective arms could improve the easiness of release of engagement between the male member and the female member, and finally, reached the present invention.

That is, the present invention provides a buckle (1) including a male member (10) having an inserting piece (12), a female member (20) having an insertion port (28) and a cover body (30) storing the female member (20) therein, wherein in the male member (10), the inserting piece (12) has a pair of concave engaged parts (12*a*, 12*b*), the female member (20) is formed of one elastic metal wire and has a base (21), a pair of arms (22*a*, 22*b*) that are bent and extend from respective ends of the base (21), a pair of bent parts (26, 26) provided in the middle of the respective arms (22*a*, 22*b*), and a pair of engaging parts (24*a*, 24*b*) provided at respective front ends of the pair of arms (22*a*, 22*b*), the cover body (30) has a cover main body (31), an insertion hole (33) into which the inserting piece (12) of the male member (10) can be inserted, a storage part (34) that communicates with the insertion hole (33) and stores the female member (20) therein, and operating parts (38, 38) that can press the pair of respective bent parts (26, 26) inward from the outside of the cover body (30), and the engaged parts (12*a*, 12*b*) of the inserting piece (12) can be engaged or disengaged with the pair of respective engaging parts (24*a*, 24*b*) as a distance between the pair of arms (22*a*, 22*b*) is widened or narrowed due to elastic deformation, and the operating parts (38, 38) are pressed to release engagement between the pair of engaged parts (12*a*, 12*b*) and the pair of engaging parts (24*a*, 24*b*).

In the buckle with such structure according to the present invention, since the female member including its engaging parts is formed merely by bending one elastic metal wire, the number of components is much smaller than that of conventional buckles, leading to light weight and very inexpensive material costs and manufacturing costs. Moreover, since the female member is formed of the metal wire, adequate strength can be achieved. Further, since the inserting piece of the male member has the pair of concave engaged parts, the stability of the inserting piece of the male member during engagement with the female member is greatly improved.

In the buckle of the present invention, it is preferred that in the cover body (30), the pair of operating parts (38, 38) are connected to respective side surfaces of the cover main body (31) at an end on the opposite side to the insertion hole (33) in a cantilevered manner.

In the buckle with such configuration according to the present invention, when releasing engagement between the pair of engaged parts and the pair of engaging parts, the user is easy to grip the male member with one hand while pressing the operating parts with the other hand (a force is easily applied), so that engagement between the pair of engaged parts and the pair of engaging parts can be released more easily.

In the buckle according to the present invention, it is preferred that in the female member (20), the pair of bent parts (26, 26) are provided closer to the pair of engaging parts (24*a*, 24*b*) than the center of the pair of arms (22*a*, 22*b*).

In the buckle with such configuration according to the present invention, when the user grips the male member with one hand and presses the operating parts with the other hand to release engagement between the pair of engaged parts and the pair of engaging parts, a force is easily applied to the pair of arms so that the distance between the pair of arms is narrowed due to elastic deformation, resulting in that engagement between the pair of engaged parts and the pair of engaging parts can be released more easily.

With the above-mentioned configuration, the pair of arms of the female member can cross each other in a middle section from the arms to the engaging parts. This can convert the operation of pressing the pair of arms from the outside into an effect of widening the distance between the engaging parts. Further, by holding the inserting piece of the male member with the arms 24*a*, 24*b* crosswise in a crossing range of the arms 24*a*, 24*b* in the thickness direction, engagement between the male member and the female member becomes stable with less backlash.

With each of the above-mentioned configuration, bent inner edges of the pair of engaging parts of the female member face each other, and a space surrounded by the pair of engaging parts may constitute the insertion port of the female member. Thus, since the engaging parts can also function as the insertion port and furthermore, the insertion port surrounded by the engaging parts can hold the inserting piece of the male member in cooperation, engagement between the male member and the female member becomes stable.

The cover body stores the female member therein, and has the insertion hole into which the inserting piece of the male member can be inserted, the storage part that communicates with the insertion hole and stores the female member therein and the operating parts that can release engagement between the engaged parts and the engaging parts from the outside of the cover body. This cover body can protect the female member against external shock and the like, and improve design of the buckle as compared to a buckle having the female member formed of the metal wire without any cover.

The cover body is also provided with a band body attachment part for coupling to the band body, and the band body attachment part can engage with the base of the female member. This can fix the cover body to the female member reliably and easily. Moreover, since the base of the female member may configure a part of the band body attachment part of the cover body, the cover body and the female member can be attached to the band body with adequate strength.

Effect of the Invention

According to the present invention, it is possible to provide a buckle that has adequate strength and a simple structure including a small number of components and is excellent in the stability of the inserting piece of the male member during engagement with the female member and the easiness of release of engagement between the male member and the female member.

BEST MODE FOR CARRYING OUT THE INVENTION

Figure 1:
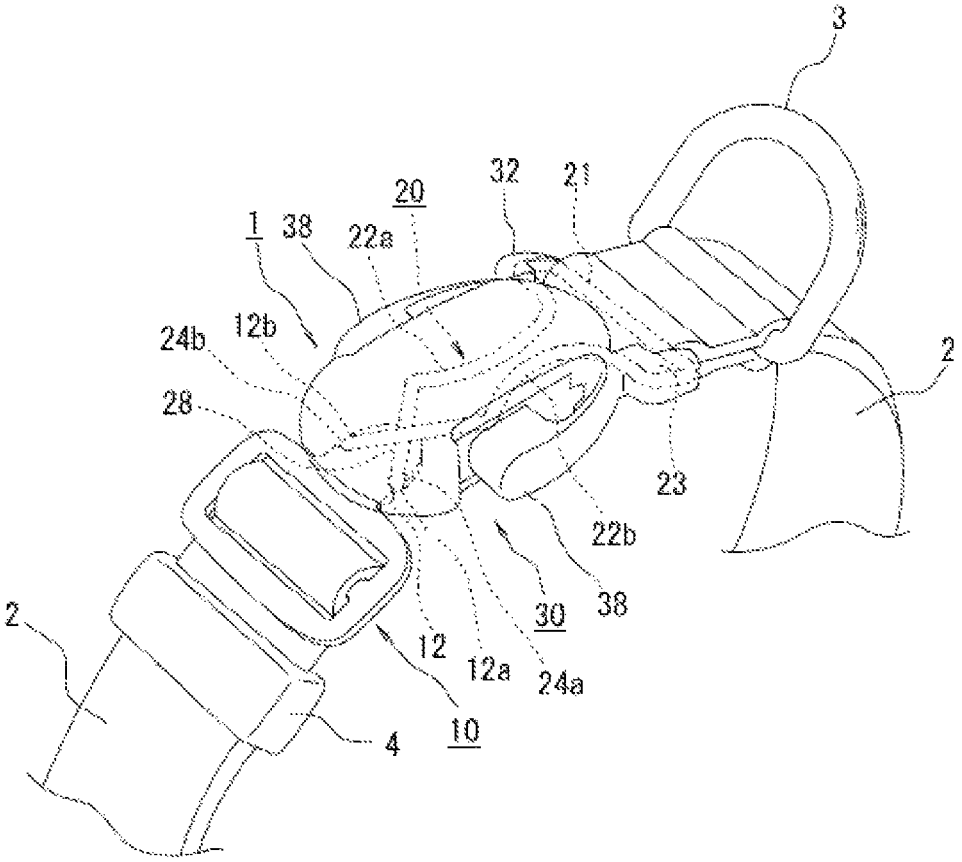
FIG. 1 A perspective view of a main section of an embodiment (collar for animals) of a buckle according to the present invention.

Although an embodiment (collar for animals) of a buckle according to the present invention will be described in detail below with reference to figures, the present invention is not limited to this embodiment. In following description, same or equivalent components may be given same reference numerals and overlapping description thereof may be omitted. The figures intend to explain concepts of the present invention and thus, for easier comprehension, size, ratio or the number of components may be exaggerated or simplified as needed.

FIG. 1 is a perspective view of a main section of the embodiment (collar for animals) of the buckle according to the present invention. The buckle 1 couples a flat band-like belt 2 as a band body. FIG. 1 does not show the whole of the belt 2, but shows only the vicinity of both ends of the belt 2, to which the buckle 1 is attached.

The buckle 1 includes, as attachments, a D ring 3 made of stainless steel, a belt ring 4 made of resin and an adjustment ring (not shown) for adjusting the length of a belt. The D ring 3, the belt ring 4 and so on are commonly-used and publicly-known articles and thus, detailed description thereof is omitted.

Figure 2:
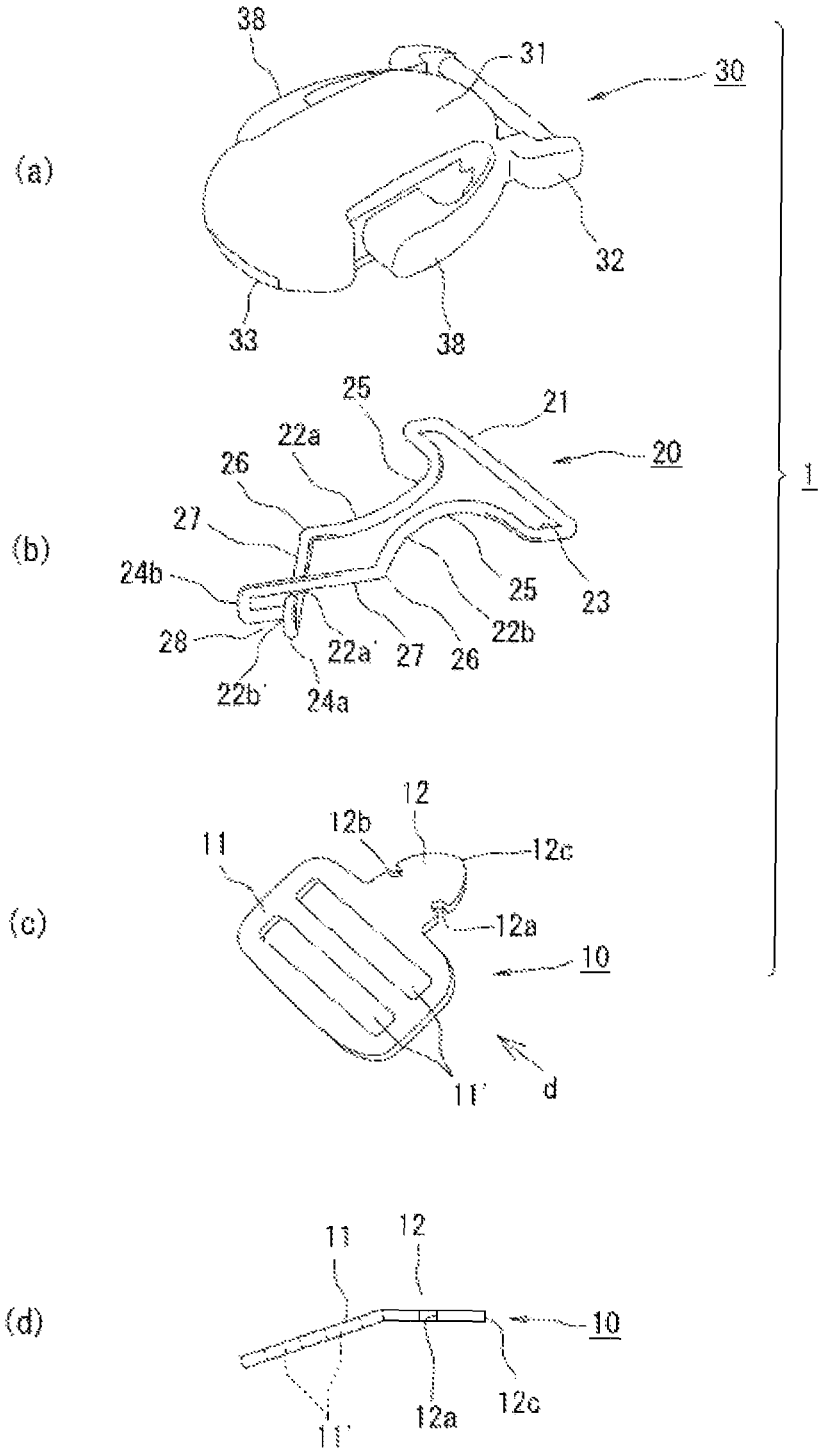
FIG. 2 Exploded perspective views showing components of the buckle shown in FIG. 1, 2(*a*) shows a cover body, 2(*b*) shows a female member, 2(*c*) shows a male member and 2(*d*) is a view (side view) taken in the direction of an arrow d in FIG. 2(*c*).

Next, the buckle 1 of this embodiment will be described in detail. FIG. 2 are exploded perspective views showing components of the buckle shown in FIG. 1, 2(*a*) shows a cover body, 2(*b*) shows a female member, 2(*c*) shows a male member and 2(*d*) is a view (side view) taken in the direction of an arrow d in FIG. 2(*c*).

The buckle 1 is mainly configured of a male member 10 attached to one end of the belt 2, a female member 20 attached to the other end of the belt 2 and a resin cover body 30 that stores the female member 20 therein.

As shown in FIGS. 2(*c*) and 2(*d*), the male member 10 is configured of an attachment part 11 for attachment to the belt 2 and an inserting piece 12 protruding from the attachment part 11, and is formed by punching a stainless steel plate. The attachment part 11 is substantially rectangular, and has two slits 11', 11' for inserting the belt 2 thereinto. As shown in FIG. 1, one end of the belt 2 is inserted into each slit 11', so that the male member 10 is attached to the belt 2 as the band body according to a publicly-known method using the belt ring 4 and so on.

The inserting piece 12 protrudes from one of two opposed long sides of the substantially rectangular attachment part 11 in a direction substantially orthogonal to the long sides. The inserting piece 12 has concave engaged parts 12*a*, 12*b* that extend in a bilaterally symmetric manner and an arcuate front end 12*c*, which presents a substantially dome-like rounded shape as a whole. This can greatly improve the stability of the inserting piece 12 of the male member 10 during engagement with the female member 20.

In the male member 10 of this embodiment, as shown in FIG. 2(*d*), the inserting piece 12 is bent relative to the attachment part 11 in the thickness direction. When the buckle 1 is attached to a curved object, for example, a neck of a pet such as a dog, this bending enables the buckle 1 to easily conform to the curved object in contact with the buckle 1. In case of applying the buckle 1 to a bag belt and the like, since the region in contact with the buckle 1 is generally flat, there is no need to bend the inserting piece 12 relative to the attachment part 11.

Next, the female member 20 that is freely engaged/disengaged with the male member 10 will be described. The female member 20 has a structure shown in FIG. 2(*b*) and FIG. 3, and is formed by bending one elastic round rod-like metal wire having a circular cross section. The elastic metal wire is preferably made of stainless steel.

The female member 20 includes a pair of arms 22*a*, 22*b* that bend and extend (protrude) from both ends of a base 21. The arms 22*a*, 22*b* extend in parallel in the same direction and then, bend so as to get closer to each other and finally, constitute a substantially rectangular annular part 23 having the base 21 as a long side. The belt 2 as the band body can be inserted into the annular part 23.

In a region ranging from the annular part 23 to below-mentioned engaging parts 24*a*, 24*b*, the arms 22*a*, 22*b* each have a curved part 25 moderately curved so that the arms are gradually away from each other, an L-like (convex) bent part 26 formed by bending at a blunt angle in the middle of the region, and a diagonal part 27 inclined so that the arms are gradually close to each other again through the bent part 26.

Figure 3:
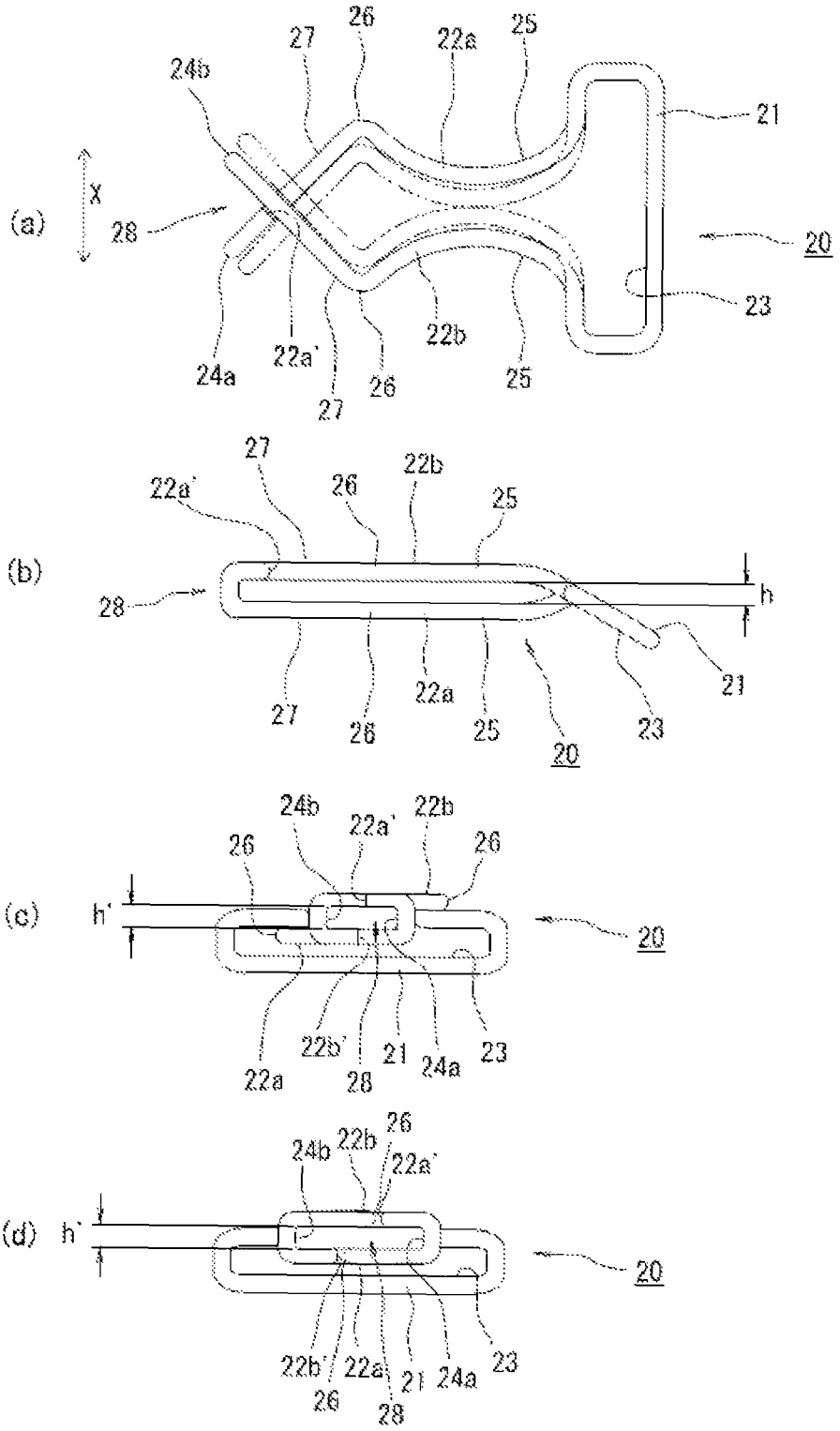
FIG. 3 Views showing the female member of the buckle shown in FIG. 1 and FIG. 2, 3(*a*) is a plan view, 3(*b*) is a front view, 3(*c*) is a left side view and 3(*d*) is a left side view corresponding to a state represented by a virtual line in FIG. 3(*a*).

As shown in FIG. 3(*b*), the diagonal parts 27 cross each other with a three-dimensional gap h. The three-dimensional gap h is almost the same as or slightly larger than the thickness of the inserting piece 12 of the male member 10.

As represented by solid lines and virtual lines in FIG. 3(*a*), in the curved parts 25, the bent parts 26 and the diagonal parts 27, the distance between the arms 22*a*, 22*b* can be widened/narrowed due to elastic deformation obtained by the elasticity of the metal wire.

Front ends of the arms 22*a*, 22*b* has the respective engaging parts 24*a*, 24*b* that can engage with the engaged parts 12*a*, 12*b* of the male member 10, respectively. The engaging parts 24*a*, 24*b* are provided (integrally formed) by bending the front ends of the arms 22*a*, 22*b* (diagonal parts 27, 27) substantially at an angle of 180 degrees in a squared U-shaped (convex) manner. The "squared U-shaped" includes rounded shape such as U-shaped, V-shaped and J-shaped, in addition to the lateral "squared U-shaped".

More specifically, given that the widening/narrowing direction of the distance between the arms 22*a*, 22*b* is a lateral direction (direction represented by an arrow X in FIG. 3(*a*)), the engaging part 24*a* is formed by folding the front end of the arm 22*a* along the arm 22*a* upward in the U-shaped manner. Conversely, the engaging part 24*b* is formed by folding the front end of the arm 22*b* along the arm 22*b* downward in the squared U-shaped manner.

A front end surface 22*a*' of the arm 22*a* faces the diagonal part 27 of the other arm 22*b* in the substantially orthogonal direction, and a front end surface 22*b*' of the arm 22*b* faces the diagonal part 27 of the other arm 22*a* in the substantially orthogonal direction. A gap h' between the engaging parts 24*a*, 24*b* is almost the same as the three-dimensional gap h between the diagonal parts 27.

Here, given that the widening/narrowing direction of the distance between the arms 22*a*, 22*b* is the lateral direction (direction represented by an arrow X in FIG. 3(*a*)), when viewed in the vertical direction, the engaging part 24*a* and the engaging part 24*b* are located so as to form a V shape. Accordingly, inner edges of the squared U-shaped recess formed by the engaging parts 24*a*, 24*b* do not face each other in parallel, but substantially face each other. A space surrounded by the engaging parts 24*a*, 24*b* constitutes an insertion port 28 into which the inserting piece 12 of the male member 10 is inserted.

When viewed toward the base 21, the insertion port 28 is rectangular, and can assume a normal state in which the distance is narrowed as shown in FIG. 3(*c*) and a state where the distance is widened as shown in FIG. 3(*d*) according to widening/narrowing (extension/contraction) of the distance between the arms 22*a*, 22*b* due to elastic deformation.

As shown in FIG. 3(*b*), like the inserting piece 12 of the male member 10 bent relative to the attachment part 11 in the thickness direction, a middle region ranging from the annular part 23 to the engaging parts 24*a*, 24*b* in the arms 22*a*, 22*b* is also bent relative to the annular part 23, for the same reason.

Figure 4:
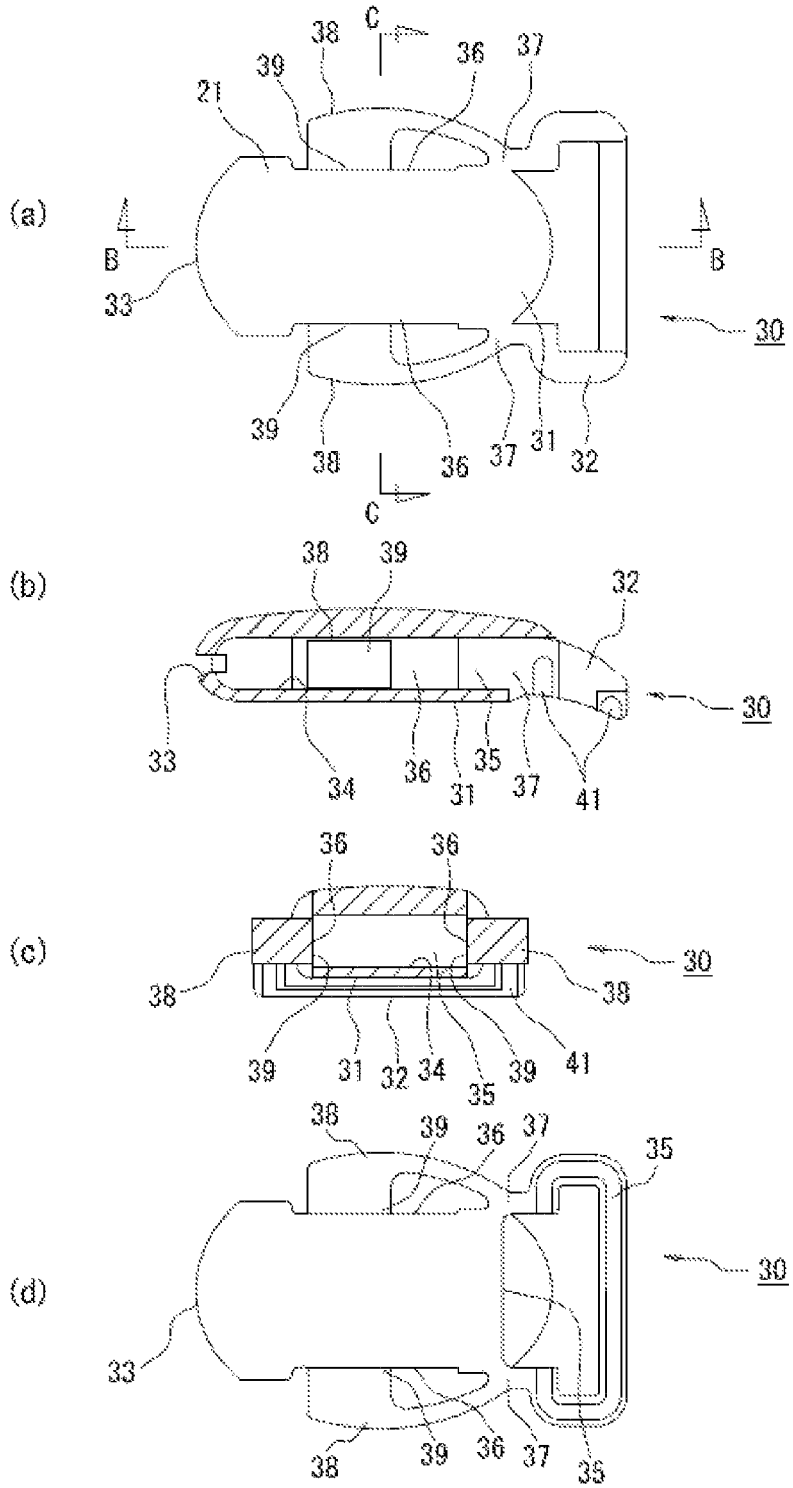
FIG. 4 Views showing the cover body of the buckle shown in FIG. 1 and FIG. 2, 4(*a*) is a plan view, 4(*b*) is a sectional view taken along a line b-b in FIG. 4(*a*), 4(*c*) is a sectional view taken along a line c-c in FIGS. 4(*a*) and 4(*d*) is a bottom view.

Next, the cover body 30 that stores (accommodates) the female member 20 therein will be described. The cover body 30 is preferably made of POM (polyacetal). and as shown in FIG. 2(*a*) and FIG. 4, is formed by protruding a frame-like band body attachment part 32 from a disc-like elliptical cover main body 31 in appearance. The belt 2 as the band body can be inserted into the band body attachment part 32. It is noted that, as shown in FIG. 4(*b*), the band body attachment part 32 is bent relative to the cover main body 31 for the same reason as that of bending of the male member 10 and the female member 20.

The cover main body 31 has a rectangular insertion hole 33 opened so as to insert the inserting piece 12 of the male member 10 thereinto on the opposite side to the band body attachment part 32, and a storage part 34 that can store the female member 20 therein is formed in an internal space communicating with the insertion hole 33. The storage part 34 has a rear opening 35 communicating with the band body attachment part 32.

Both side surfaces of the cover main body 31 have respective side openings 36 that are formed by cutting a part of the side surfaces and communicate with the storage part 34, and cantilever operating parts 38 are swingably provided via hinges 37 connected to opened edges of the respective side openings 36. That is, the operating parts 38 are connected to the respective opened edges of the side openings 36 located on the both side surfaces of the cover main body 31 at an end on the opposite side to the insertion hole 33. This structure facilitates the user to press the cover body 30 and the operating parts 38 with one hand while pulling the male member 10 with the other hand, thereby releasing engagement more easily.

Each of the operating parts 38 has a protrusion 39 on the side of the storage part 34 as the internal space of the cover main body 31, and the protrusions 39 are oriented so as to be capable of entering into the storage part 34 through the respective side openings 36. As described later, the protrusions 39 can come into contact with the bent parts 26 of the stored female member 20, and pressing the operating parts 38 can release engagement between the male member 10 and the female member 20. An irregular anti-slip (not shown) may be formed on an outer surface of each operating part 38.

The band body attachment part 32 has a groove 41 recessed along the shape of the frame, and the groove 41 is shaped so as to engage with the annular part 23 including the base 11 of the female member 20.

Figure 5:
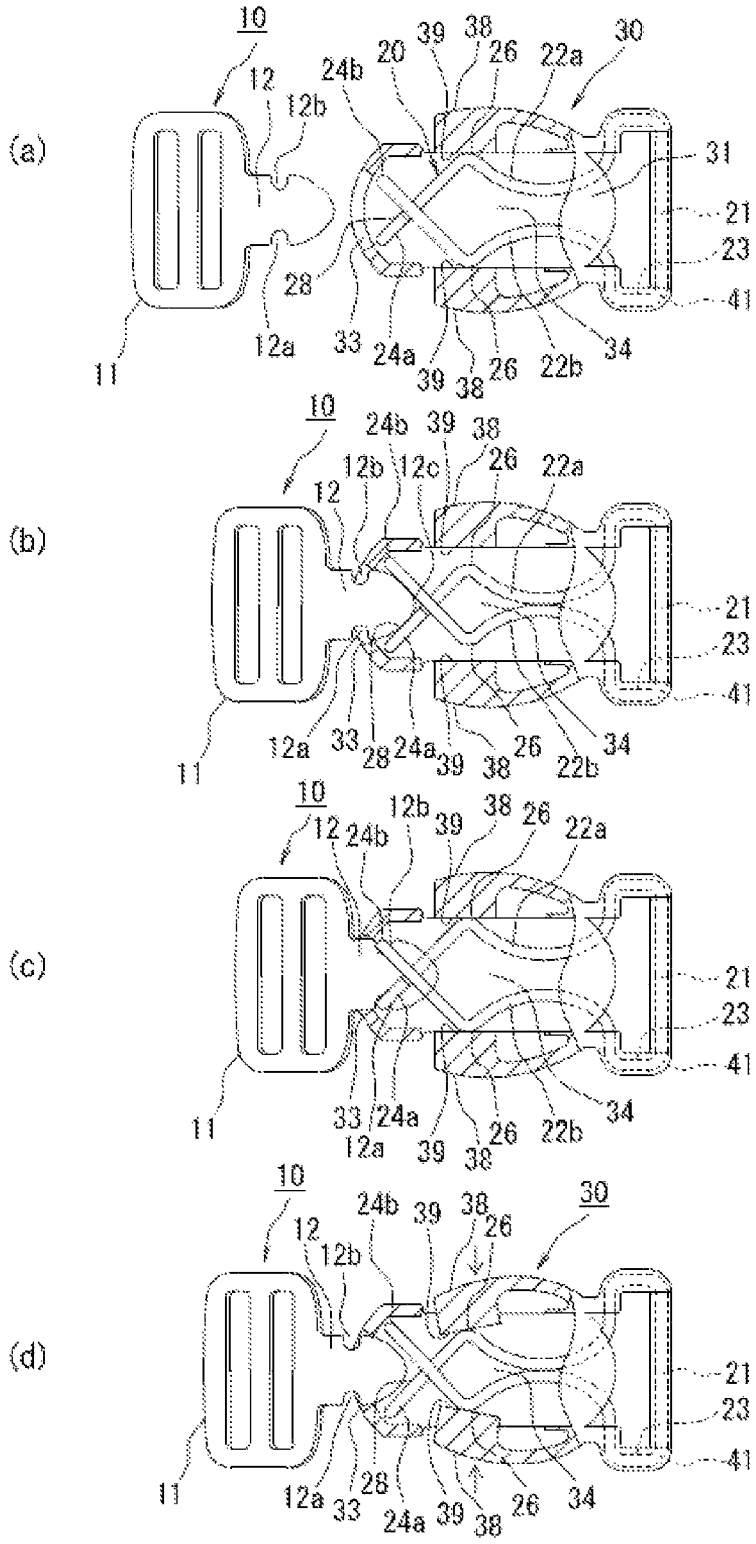
FIG. 5 Partial broken plan views showing operations of coupling and releasing the buckle shown in FIG. 1 and FIG. 2, 5(*a*) shows a state before coupling, 5(*b*) shows a state immediately before coupling, 5(*c*) shows a coupling state and 5(*d*) shows a state in the course of release of coupling.

Next, a method of storing the female member 20 in the cover body 30 will be described. As shown in FIG. 5(*a*), storage of the female member 20 in the cover body 30 is completed by inserting the arms 22*a*, 22*b* of the female member 20 into the storage part 34 through the rear opening 35 of the cover main body 31 and engaging the annular part 23 with the groove 41 of the band body attachment part 32.

By engaging the annular part 23 including the base 21 with the groove 41 of the band body attachment part 32, the insertion port 28 of the female member 20 is positioned so as to correspond to the insertion hole 33 of the cover body 30. This positioning allows each bent part 26 of the arms 22*a*, 22*b* to come into contact with the protrusion 39 of the operating part 38, and the annular part 23 to serve as a core of the band body attachment part 32.

Then, the other end of the belt 2 is inserted into the band body attachment part 32 and as shown in FIG. 1, the female member 20 stored in the cover body 30 is attached to the belt 2 as the band body by confrontation or the like.

Next, referring to FIG. 5, a method of coupling/releasing the buckle 1 will be described. First, to couple the buckle 1, as shown in FIG. 5(*b*), the inserting piece 12 of the male member 10 is inserted into the insertion port 28 of the female member through the insertion hole 33 of the cover body 30.

When it is attempted to insert the inserting piece 12 into the insertion port 28, since the engaging parts 24*a*, 24*b* that constitute the insertion port 28 each are formed of a round rod-like metal wire having a circular cross section and the front end 12*c* of the inserting piece 12 is arcuate, the distance (insertion port 28) between the engaging parts 24*a*, 24*b* is smoothly widened along the arc against an elastic force caused by elasticity of the arms 22*a*, 22*b*.

When the inserting piece 12 is further inserted into the insertion port 28, the engaging parts 24*a*, 24*b* run past both ends of the inserting piece 12, which extend in the shape of an arc, and the distance (insertion port 28) between the engaging parts 24*a*, 24*b* is narrowed by the elastic force caused by the elasticity of the arms 22*a*, 22*b*, resulting in that the engaging parts 24*a*, 24*b* engage with the engaged parts 12*a*, 12*b* of the inserting piece 12, respectively, as shown in FIG. 5(*c*).

In this engagement state, the inserting piece 12 of the male member 10 is held by the arms 24*a*, 24*b* of the female member 20 crosswise in a crossing range of the arms 24*a*, 24*b* in the thickness direction (front-back direction in back FIG. 5(*c*)), thereby becoming stable relative to the female member 20 with small backlash. Especially since the inserting piece 12 has the concave engaged parts 12*a*, 12*b*, the engaging parts 24*a*, 24*b* fit into the concave parts, achieving to an extremely high stability of the inserting piece 12 of the male member 10 during engagement with the female member 20.

Conversely, to release coupling of the buckle 1, as shown in FIG. 5(*d*), the operating parts 38 of the cover body 30 are pressed from the outside to widen the distance (insertion port 28) between the engaging parts 24*a*, 24*b*, and the inserting piece 12 of the male member 10 is pulled out.

That is, when the operating parts 38 of the cover body 30 are pressed from the outside, the operating parts 38 swing through the respective hinges 37, and the protrusions 39 enter into the storage part 34 and press the respective bent parts 26 of the arms 22*a*, 22*b*. At this time, since the bent parts 26 are provided closer to the engaging parts 24*a*, 24*b* than the center of the arms 22*a*, 22*b*, a force is easily applied to the arms 22*a*, 22*b* so that the distance between the arms 22*a*, 22*b* is narrowed due to elastic deformation, resulting in that engagement between the engaged parts 12*a*, 12*b* and the engaging parts 24*a*, 24*b* can be released more easily.

When the bent parts 26 are pressed, since the arms 22*a*, 22*b* cross each other in their middle section, the distance (insertion port 28) between the engaging parts 24*a*, 24*b* is widened due to elastic deformation of the arms 22*a*, 22*b* to release engagement between the engaging parts 24*a*, 24*b* and the engaged parts 12*a*, 12*b* of the inserting piece 12, and then, by pulling out the inserting piece 12 of the male member 10, coupling of the buckle 1 is released.

By use of the male member 10 formed of one stainless steel plate and the female member 20 formed by bending one stainless steel material, the buckle 1 of this embodiment can be advantageously manufactured with smaller weight and at lower costs while maintaining equivalent strength as compared to the conventional metal buckle.

Although this embodiment has been described as the buckle suited for the collar for animals, various changes can be made in design within the scope of technical concept of the present invention. As a matter of course, the buckle according to the present invention can be used as buckles for bags and pouches.

For example, the operating parts 38 of the cover body 30 in this embodiment can be omitted to directly operate the arms 22*a*, 22*b* through the side openings 36 of the cover body 30, thereby releasing engagement of the buckle. Further, the cover body does not need to store the female member 20 therein, and may be a plate or sheet as a mere partition wall that serves to prevent direct contact of the female member 20 with an animal neck, a bag or the like.

The band body 2 may be a round cord in place of the flat band-like belt. In this case, as a matter of course, the shape of the attachment part of the male member, the annular part of the female member and the band body attachment part of the cover body may be appropriately changed according to the shape of the band body.

DESCRIPTION OF REFERENCE NUMERALS

1: buckle,
2: band body,
10: male member,
12: inserting piece,
12*a*, 12*b*: engaged part,
20: female member,
21: base,
22*a*, 22*b*: arm,
23: annular part,
24*a*, 24*b*: engaging part,
28: insertion port,
30: cover body,
32: band body attachment part,
34: storage part,
38: operating part.

What is claimed is:

1. A buckle comprising: a male member including an inserting piece, a female member including an insertion port and a cover body storing the female member therein, wherein:

in the male member, the inserting piece has a pair of concave engaged parts;

the female member is formed of one elastic metal wire and has a base, a pair of arms that are bent and extend from respective ends of the base, a pair of bent parts provided in the middle of the respective arms, and a pair of engaging parts provided at respective front ends of the pair of arms;

the cover body has a cover main body, an insertion hole into which the inserting piece of the male member can be inserted, a storage part that communicates with the insertion hole and stores the female member therein, and operating parts that can press the pair of respective bent parts inward from the outside of the cover body; and the engaged parts of the inserting piece can be engaged or disengaged with the pair of respective engaging parts, as a distance between the pair of arms is widened or narrowed due to elastic deformation, and the operating parts are pressed to release engagement between the pair of engaged parts and the pair of engaging parts.

2. The buckle according to claim 1, wherein in the cover body, the pair of operating parts are connected to respective side surfaces of the cover main body at an end on the opposite side to the insertion hole in a cantilevered manner.

3. The buckle according to claim 1, wherein in the female member, the pair of bent parts are provided closer to the pair of engaging parts than the center of the pair of arms.

4. The buckle according to claim 1, wherein in the female member, the pair of arms cross each other in a middle section from the pair of bent parts to the pair of engaging parts.

5. The buckle according to claim 1, wherein in the female member, bent inner edges of the pair of engaging parts face each other and a space surrounded by the pair of engaging parts constitute the insertion port.

* * * * *